US007763469B2

(12) United States Patent
Babichenko et al.

(10) Patent No.: US 7,763,469 B2
(45) Date of Patent: Jul. 27, 2010

(54) METHOD FOR AUTOMATIC ENCRYPTED MARKING AND IDENTIFYING THE LIQUIDS

(75) Inventors: Sergey Babichenko, Tallinn (EE); Alexander Dudelzak, Nepean (CA); Larisa Poryvkina, Tallinn (EE)

(73) Assignee: AS Laser Diagnostic Instruments, Tallinn (EE)

( * ) Notice: Subject to any disclaimer, the term of this patent is extended or adjusted under 35 U.S.C. 154(b) by 727 days.

(21) Appl. No.: 10/588,539

(22) PCT Filed: Mar. 15, 2005

(86) PCT No.: PCT/EE2005/000004

§ 371 (c)(1),
(2), (4) Date: Aug. 7, 2006

(87) PCT Pub. No.: WO2005/090527

PCT Pub. Date: Sep. 29, 2005

(65) Prior Publication Data

US 2007/0178596 A1 Aug. 2, 2007

(30) Foreign Application Priority Data

Mar. 23, 2004 (EE) ..... 200400072

(51) Int. Cl.
*G01N 33/00* (2006.01)

(52) U.S. Cl. ..... 436/56; 436/43; 436/174

(58) Field of Classification Search ..... 436/56, 436/43, 174

See application file for complete search history.

(56) References Cited

U.S. PATENT DOCUMENTS

| | | | |
|---|---|---|---|
| 4,209,302 | A | 6/1980 | Orelup |
| 5,205,840 | A | 4/1993 | Friswell et al. |
| 5,279,967 | A | 1/1994 | Bode |
| 5,958,780 | A | 9/1999 | Asher et al. |
| 6,294,110 | B1 | 9/2001 | Friswell et al. |

FOREIGN PATENT DOCUMENTS

| | | |
|---|---|---|
| EP | 0 385 441 B1 | 4/1993 |
| WO | WO 9 632 462 | 10/1996 |

OTHER PUBLICATIONS

Kaplan, Isaac R, et al., Forensic Environmental Geochemistry: differentiation of fuel-types, their sources and release time, *Organic Geochemistry*, vol. 27, issues 5-6, Oct. 11, 1997, pp. 289-317, Abstract.

*Primary Examiner*—Sam P Siefke
(74) *Attorney, Agent, or Firm*—Ladas & Parry LLP

(57) ABSTRACT

The invention provides a method for automatic encrypted marking of liquids and for identifying liquids marked by using this method. For marking certain number of markers is selected and for every marker a random number is generated, which define the amount of a marker used. Based on the number of markers, their measured concentrations and the relation of markers concentrations in the marked liquid, a specific marking code is compiled, characteristic only for this liquid. The marking code is encrypted and delivered to an authorized user. The encrypted marking code is decrypted and for identifying the liquid the original parameters contained in the marking code are compared with parameters actually measured on-site. This identification is carried out automatically in real time without any need for laboratory analyses, thus practically excluding human factor in both the marking and identification processes.

9 Claims, 2 Drawing Sheets

METHOD FOR AUTOMATIC ENCRYPTED MARKING AND IDENTIFYING THE LIQUIDS

FIELD OF THE INVENTION

Invention relates to a method for marking and identifying various liquids, such as gasoline, diesel fuel, crude oil and other oil products, dangerous or regulated liquid chemicals, liquid waste products, pharmaceutical liquids, industrial waters and liquids, ballast and bilge waters, etc. The field of the invention is not limited to above enlisted liquids.

BACKGROUND OF THE INVENTION

Marking the liquids for their distinguishing is know from the prior art for a relatively long time. For the first time an organic dye was used to identify Pb-containing fuels already in 1926. Later on the dye additions were used to mark gasoline sold exclusively for the use in agriculture, or for marking vehicles that had paid highway taxes and for a number of other purposes. At present all bigger oil companies such as Shell, Unocal, Arco, Chevron, Lukoil etc. use different dye additives for marking different gasoline brands (Kaplan, I. et al "Organic Geochemistry" 27(5), 289-317, 1997). The main purpose for using marking additives is to identify the origin of gasoline, first of all in connection with taxation or environment protection.

The more general purpose of using markers is to create liquid identity in order to distinguish specific liquid from similar liquids. In case the marker is not detected in a presumably marked liquid, then this indicates that the liquid is not original. When the marker is detected in a liquid, then this indicates that the liquid comes from its' actual producer. The last statement is valid only on a precondition that the marker is not falsified and that it is the same one as was used in original products' marking process. In many cases for increasing marking security it is preferable to use such marking that the marker contained in the marked product is not visible to regular user, but is detectable by an authorized user (i.e. official customer). Such marking is referred to as "hidden marking".

However, despite of a rapid elaboration and active use of "hidden marking" methods the "hidden marking" does not guarantee really effective identification of factual origin of liquids, including fuels, and does not prevent their illegal use, blending or counterfeit, neither does it make possible to identify a real polluter of the environment after the liquid has been spilled to the ground or flown to water reservoirs. This is due to following several reasons.

i) It is possible to simulate or camouflage analyses results by adding similar additives.

ii) For identifying marked liquid sampling together with following detailed laboratory analyses is necessary, due to which the identification process is often time consuming and costly. The marking methods used at present are without exceptions based on laboratory analyses.

iii) The know so far ways of "hidden marking" are in a considerable scale influenced by human factor. Even in case the used recipe of markers or marking procedure are secret, or a specific detection procedure is used, there exists a potential danger of their disclosing or discovering.

In order to overcome the recited shortcomings different improvements of marking and analysing methods have been proposed.

In order to overcome shortcomings indicated above in (i) new markers have been developed which are hard to eliminate from the fuel by simple chemical or physical procedures, as for example C16-C26-n-alkane) (RU 2 199 574, Rubanik, S. I. et al "*Chemical marker*", but especially markers which can be added in small quantities, as for example 1,4-dimethyl-2-nitro-benzene (EP 0 385 441, Papa Sisto Sergio "*Marker for petroliferous products*"), C1-C6 alkyl (U.S. Pat. No. 5,205,840, Friswell Michael R. "*Markers for petroleum, method of tagging and method of detection*") and composite markers (U.S. Pat. No. 4,209,302, Orelup, Richard B. "*Marker for petroleum fuels*"), and which can be detected by easy laboratory tests. They include colorless markers which become visible after adding chemical reagent (WO 9 632 462, Desaj Bkharat, et al "*Composition including thymol-phthaleine marker, method and solution for marking petroleum product, and a method for identification of petroleum product*"), or specific combinations of markers mutually cancelling each other's colour when introduced into liquid (U.S. Pat. No. 6,294,110, Zimin Sr Al, et al "*Colour cancelling marking systems*". Some developments are connected with markers requiring a unique detection procedure in order to obtain more secure marking.

In order to overcome shortcomings indicated in (ii) methods and marking systems have been worked out for automation of marking and identification processes, resulting in simplification of marking and identification of liquids. In document WO 0 240 274 (Altenkirche, Günter et al "*Marking device and extrusion system with a marking device of this type*" a precise pumping system for marking of liquids is described. In a document WO 02 098 199 (Sochin, Moshe et al "*Method and system for marking and determining the authenticity of liquid hydrocarbons*" a microprocessor controlled marking and identification of a liquid flowing from a source (cistern) to a destination (storage tank).

In practice the combinations of markers or compound materials are used for marking. In document U.S. Pat. No.5,958,780 is described a marking system, which is based on the predefined concentration ratio of at least two markers miscible with the liquid. The ratio of a second marker concentration and first marker concentration, which is defined using optical absorption spectrum or fluorescence radiation spectrum, is compared with predefined value to identify the liquid.

In spite of numerous improvements made in marking and identification technologies the problem indicated above in (iii) is still not solved and hampers achieving of a totally secure marking. In addition, revealing of what so ever unique features concerning markers, marking and identifying processes is possible (either by steeling the information, selling the information to the interested third parties, etc), which makes falsification of a marked liquid possible.

In present invention a fully automatic marking method and a marking system for applying this method are proposed, by means of which all disadvantages indicated above in (i) to (iii) have been eliminated. This was possible due to the following.

In this invention no such secret information is used which in reality could be disclosed to the interested entities. According to the invention a variety of different and suitable for that purpose markers can be used, whereby data concerning markers used for marking is contained in encrypted code, and it is possible to alter the markers and their concentration for any batch of liquid to be marked next (please see point (i) above). The identification procedure proposed in the invention can be carried out on-site (in real time) in a simple and fast manner without a need for laboratory analyses (please see point (ii) above).

Marking and identifying process are automatic using encrypting/decrypting means, in which case the influence of human factor as such is practically excluded (please see (iii) above).

SUMMARY OF THE INVENTION

In present invention a method and a system for automatic marking of liquids and following identification of marked liquids using the method of present invention. The marking method according to the invention comprises the following steps:

a) Selecting at least two, preferably more markers (i.e. the so called marking liquids—hereinafter markers—containing substances used for marking), which are miscible in a liquid to be marked and which have characteristic spectral features for distinguishing them from the marked liquid without the need to extract said markers from the marked liquid, while characteristic features are marker's optical absorption spectra or fluorescence excitation/emission spectra must be clearly distinguished within at least one wavelength range, within which the absorption spectra or the fluorescence spectra (or both) of different markers are mutually different, and in addition to that they must differ from both the absorption spectrum or the fluorescence spectrum of the marked liquid itself and also from the absorption spectrum or the fluorescence spectrum of any other marker also used in this liquid.

b) Markers and their quantities to be introduced into the marked liquid are determined.

c) Markers are added to the liquid to be marked.

d) Concentration of each single marker and mutual relationship between markers concentrations in marked liquid is determined.

e) After marking of the liquid a unique code identifying this marked liquid is formed, which contains data about the used markers, markers concentration and their mutual ratios, and this code is encrypted.

f) Immediately after the marking is completed the marking code is checked and if necessary it is adjusted. The adjustment may be necessary in case if the spectra on the markers contained in the liquid practically overlap or are too close to each other.

Thereafter the encrypted code is delivered to the authorized user (official customer) together with the marked liquid in order to enable its on-site identification on arrival.

A method of identification of the liquid after marking includes the following steps:

a) On arrival of the marked liquid the authorised user (official customer) inserts received code into decrypting module.

b) As a result of decrypting of the encrypted code the data on used markers, markers concentrations and their mutual ratios are revealed and used for further liquid identification.

c) The specific spectral features of the used markers are verified by measuring optical absorption spectra and/or fluorescence spectra.

d) The actual concentration of every marker in the marked liquid is automatically determined based on the value of absorption coefficient or by the intensity of fluorescence in the spectral range corresponding to characteristic spectral features.

e) The correspondence of markers measured concentrations and their mutual ratio to the original values defined by encrypting code is verified.

In case if the markers measured concentrations values are substantially identical with the original values, then this means that the marking has been identified as original and the liquid having respective marking is identified as original.

According to the method of the invention the encrypting code used for marking any new amount of liquid can be different from the previous marking codes.

The method proposed in the invention makes falsification or camouflaging of analyses results by adding similar additives practically impossible because the original values of markers and their measured specific spectral features are protected by encrypted code and can be different for each next batch of liquid. This makes it possible to exclude the influence of human factor to marking of liquids.

DETAILED DESCRIPTION

In the following the system for implementing of the marking method according to the invention, increasing marking security is described with references to the figures.

Figure 1:
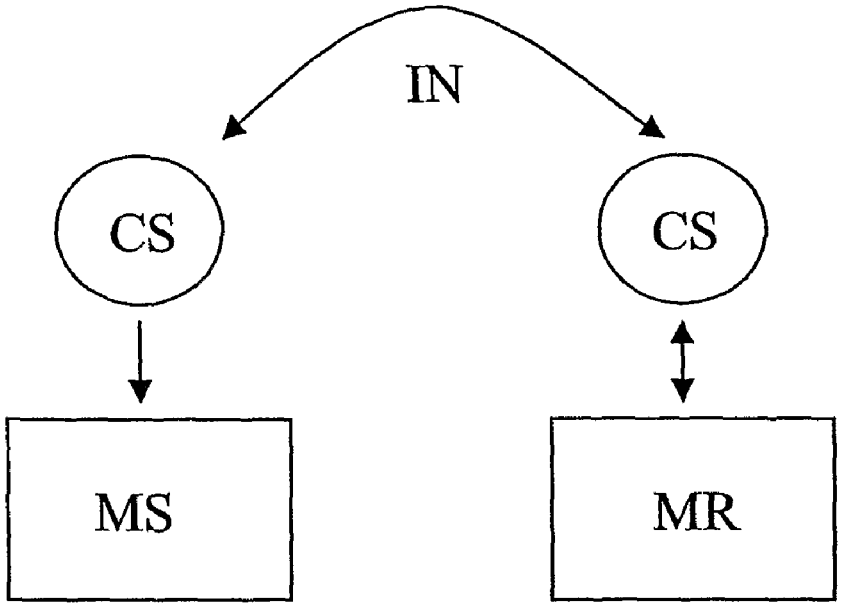
In FIG. 1 are depicted main elements of the system for encrypted marking and identification of liquids, in FIG. 2 is presented a schematic block diagram of a marking station (MS), in FIG. 3 is presented a schematic block diagram of a marker reader (MR), and in FIG. 4 is illustrated functioning of the system for encrypted marking and identification of liquids.

In FIG. 1 are shown the main elements of the marking system. The marking system contains marking station (MS), marker reader (MR),control software (CS) containing encrypting and decrypting modules and information network (IN).

Figure 2:
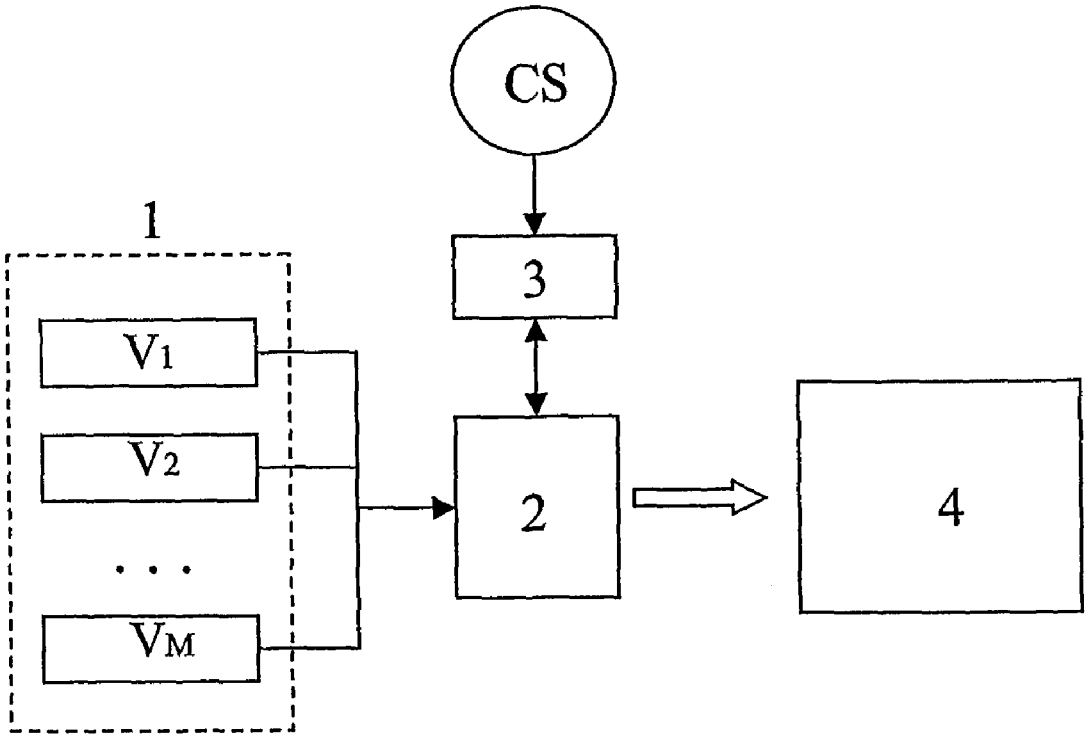

In FIG. 2 is shown a schematic block diagram of the marking station (MS). As can be seen from the figure, the marking station (MS) includes a number of containers $V_1, V_2, \ldots V_M$ with markers, marking head 2 for introducing markers into the liquid to be marked by fixed volume portions, and a microprocessor 3 for controlling of the marking and containing control software (CS) including encryption module.

Figure 3:
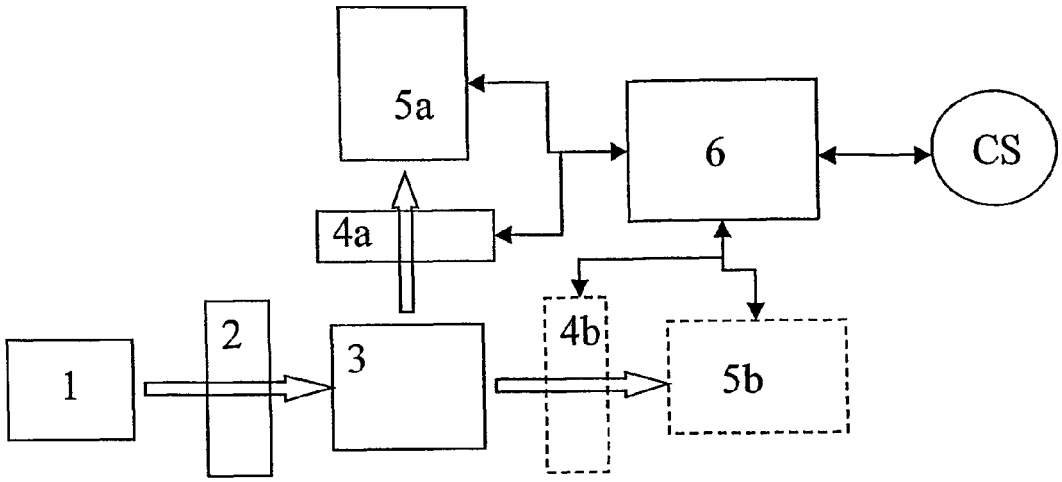

In FIG. 3 is shown a schematic block diagram of the marker reader (MR) controller by microprocessor 6. Marker reader (MR) operates based on detection of either optical absorption spectrum, fluorescence spectrum or their combination. Marker reader (MR) contains primary spectral selection unit 1 together with light source 2, manually operated or flow-through sample chamber 3, and secondary spectral selection unit 4, the primary part 4*a* of which is used for measuring the fluorescence spectra and secondary part 4*b* is used for photometric measurements. The fluorescence and absorption are measured by photodetectors 5*a* and 5*b*, and microprocessor 6 with control software containing encryption module provides signal processing.

Original concentrations of markers are selected at random using the generated for this purpose random numbers. The marking code formed after marking, which contains data about the markers used for marking, is encrypted and upon identifying of the marked liquid this encryption code is used as a key to set-up of measuring and analyses procedures performed by marker reader (MR).

Figure 4:
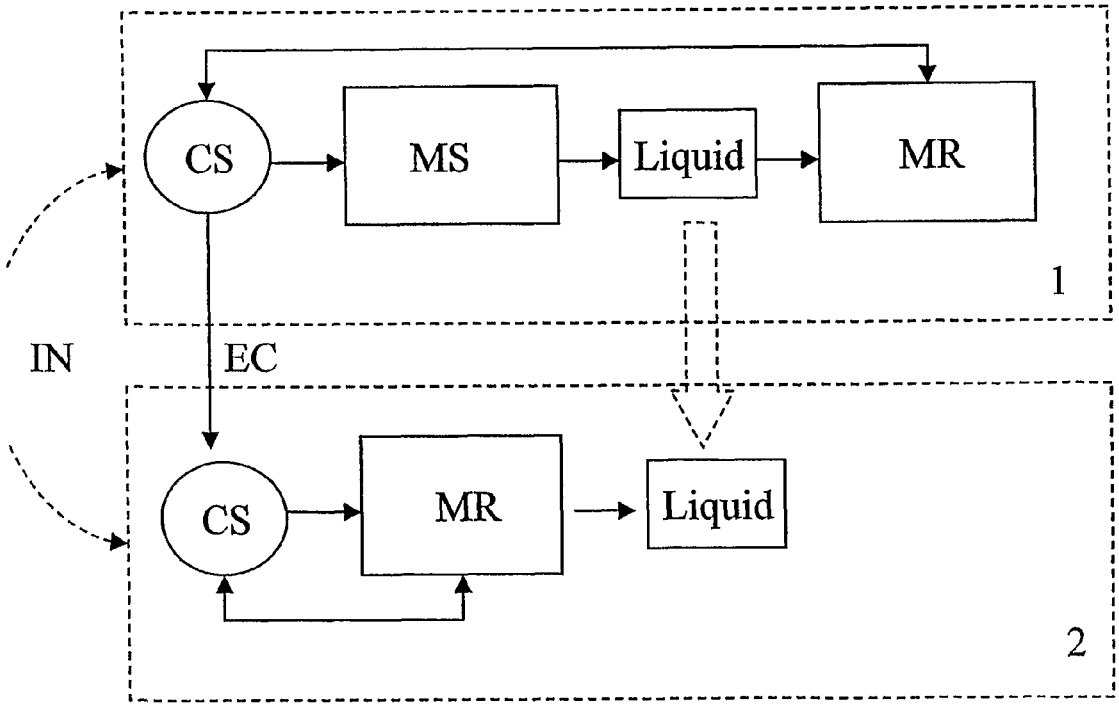

In FIG. 4 is shown the system for encrypted marking and identification of liquids, which contains part 1 for marking of the liquid and delivering it to the authorised user (official customer), and part 2 on the side of the authorised user (official customer). Forwarding of the marked liquid to the authorised user (official customer) is depicted by a dashed line arrow, and both parts 1 and 2 of the system are connected with each other with information network IN.

The system for encrypted marking and identification of liquids works as follows.

When marking process starts, the control software (CS) in the marking station (MS) and containing encryption module generates N random number and marking station marks the liquid using N different markers $M_N$, whereby 1 to M portions of each marker is used. When marking process is completed, the marker reader (MR) determines the spectral features of the marked liquid and encryption module encrypts marking code, including measured concentrations of markers in the marked liquid and their ratio, into encrypted code.

Encrypted code (EC in FIG. 4) is delivered to the authorised user of the marked liquid (official customer) together with shipment of liquid marked with respective encrypted code. Upon arrival of the marked liquid and encrypted code to the destination point encrypted code is inserted into marker reader (MR). Control software, contained in marker reader (MR) and including decrypting module, decrypts the code and provides the use of proper measuring settings in marker reader (MR). Marker reader is used to perform measurements and analyses verifying identity of the liquid.

Connecting marker reader (MR) to information network (IN) allows to. forward results of liquid identity control. In certain cases information network (IN) may be used for enhancing security.

The information network (IN), through which both encrypted marking codes and various measurement results are transmitted, can be either a local information network (LIN) or a global information network (GIN).

When marker reader (MR) is installed in a storage volume with marked liquid and is continuously activated by encrypting code, then through local information network (LIN) an alarm concerning changing of the status of the liquid (blending, dilution, etc.) may be forwarded.

Global information network (GIN) may be used to control liquid distribution and receiving by authorized users (official customers).

The main features of the marking method and system according to the invention are:

- high security, protection of marked liquid against deception, imitation and reproduction:
- parameters can be monitored in real-time and detected on-site without any need for laboratory tests;
- possibility to work in a network in on-line mode, to trace identity of a liquid at every stage of delivery/distribution chain and to report in real-time data pointing any alteration of the liquid.

EXAMPLE

Marking station (MS) has three (3) containers with markers and markers numbered by serial numbers n=1, 2, 3, . . . , N are used for encrypted marking. It is possible to add maximally up to six (6) fixed portions of every marker n, i.e. it is possible to add either 1, 2, 3, 4, 5 or 6 portions of marker.

Marking starts with selection of 3 markers from n markers and filling marking volumes with markers. The numbers of selected markers are the input parameters of the software at marking station. At the beginning of every marking process the software generates 3 integer random numbers in the range of 1 to 6. These random integers correspond to the number of fixed volume portions of each marker introduced into the marked liquid during marking. For example, the combination of numbers 234 generated during generation of random numbers defines addition of two (2) portions of a marker from marking volume 1, three (3) portions of marker from marking volume 2 and four (4) portions of a marker from marking volume 3. In case of three (3) different marking solutions and six (6) portions the total number of possible different and unrepeatable marking combinations is 816.

When addition of markers into the liquid to be marked is completed, the marker reader (MR) determines spectral features of respective markers and measures concentration of markers. Values of measured concentrations $c_1$, $c_2$ and $c_3$ depend on the number of marker portions added upon marking and on the volume of the liquid marked. Further the ratio of concentration of each marker to the concentration of next marker is calculated, i.e. the ratios $i_1=c_1/c_2$ and $i_2=C_2/c_3$. The ratio of measured concentrations can differ from the ratio of markers used for marking due to possible influence of spectral properties of the marked liquid itself (spectral background of the liquid). Based on measured values $c_1$, $c_2$ and $c_3$ and calculated values $i_1$, and $i_2$ a unique unrepeatable ID code is formed, which identifies marked liquid, for example ID=<$n_1$, $n_2$, $n_3$, $c_1c_2$, $c_3$, $i_1$, $i_2$>.

The first three numbers in this code indicate serial numbers of used markers, next three numbers correspond to measured concentrations, and two last numbers correspond to markers concentration ratios. By using encryption software, for example DES (Data Encryption Standard) procedure (*Federal Information Processing Standards Publication* 46-2 *FIPS PUB* 46-2) or IDEA (International Data Encryption Algorithm) (Lai, X(1992) "*On the Design and Security of Block Ciphers* ", *volume* 1 *of ETH Series in Information Processing. Hartung-Gorre Verlag*), a 8-position encrypted code ID(E)=ABCDEFGH is obtained.

The encrypted code is delivered together with marked liquid to the authorised user (official customer). The numeric value of this encrypted code is used as an input parameter of marker reader (MR) decryption module. After completing the decryption process the original values of $n_1$, $n_2$, $n_3$, $c_1$, $c_2$, $c_3$, $i_1$, $i_2$ restored by marker reader are obtained and they are used by marker reader (MR) as reference values during the following concentration measurements. Marker reader (MR) measures concentrations $c_1$, $c_2$, $c_3$ and determines ratios $i_1$, and $i_2$. Measured and calculated values are compared with corresponding values obtained during decryption of ID(E) code and a decision is made whether the liquid is genuine or counterfeit.

The invention claimed is:

1. Method for automatic marking of liquids using encryption, the method including following steps:

selecting at least two, preferably more markers, which are miscible in a liquid to be marked and which have characteristic spectral features for distinguishing them from the marked liquid without the need to extract said markers from the marked liquid, while characteristic features are marker's optical absorption spectra or fluorescence (excitation/emission) spectra must be clearly distinguished within at least one wavelength range, within which the absorption spectra or the fluorescence spectra (or both) of different markers are mutually different, and in addition to that they must differ from both the absorption spectrum or the fluorescence spectrum of the marked liquid itself and also from the absorption spectrum or the fluorescence spectrum of any other marker also used in this liquid, determining quantities of markers to be introduced into the marked liquid, introducing markers to the liquid to be marked, and determining concentration of each single marker and calculating mutual relationships between markers concentrations in marked liquid, and forming, on the bases of these data, for each marked liquid an unique identifying marking code characteristic only to this liquid volume, whereby the method is characterized by the following steps:

generating for each marker to be introduced into a liquid to be marked of a random number, the value of which determines the number of fixed volume portions of the marker to be introduced into the liquid to be marked, introducing markers into a liquid to be marked automatically without human involvement checking and if necessary adjusting the marking code immediately after the marking is completed, and encrypting the marking code identifying the marked liquid.

2. Method according to claim 1, characterized in that the marking code used for marking of the next liquid volume can be selected different from the previous marking code.

3. Method according to claim 1, characterized in that after the marking is completed the marking code is checked on-site by marking station's marker reader in real time.

4. Method for identifying liquids marked by using a method according to claim 1, the method including the following steps:

determining by optical absorption spectrum or fluorescence spectrum the specific spectral features of the markers used for marking of the liquid, determining, based on the optical absorption spectrum or intensity of fluorescence spectrum in respective spectral range, the actual concentration of every marker in the marked liquid, whereby the method is characterized by following steps:

inserting, upon receipt, the encrypted marking code identifying the marked liquid into the decrypting module, decrypting of the encrypted marking code, and as a result obtaining data on markers originally used for marking, on markers concentrations and mutual ratios of their concentrations, checking the measured concentrations and their mutual ratios correspondence to the values obtained by decrypting of encrypted marker code, and deciding whether the liquid is original or falsified.

5. Method according claim 4, characterized in that identification of the marked liquid is carried out automatically on-site and in real time.

6. Method for identifying liquids marked by using a method according to claim 2, the method including the following steps:

determining by optical absorption spectrum or fluorescence spectrum the specific spectral features of the markers used for marking of the liquid, determining, based on the optical absorption spectrum or intensity of fluorescence spectrum in respective spectral range, the actual concentration of every marker in the marked liquid, whereby the method is characterized by following steps:

inserting, upon receipt, the encrypted marking code identifying the marked liquid into the decrypting module, decrypting of the encrypted marking code, and as a result obtaining data on markers originally used for marking, on markers concentrations and mutual ratios of their concentrations, checking the measured concentrations and their mutual ratios correspondence to the values obtained by decrypting of encrypted marker code, and deciding whether the liquid is original or falsified.

7. Method according claim 6, characterized in that identification of the marked liquid is carried out automatically on-site and in real time.

8. Method for identifying liquids marked by using a method according to claim 3, the method including the following steps:

determining by optical absorption spectrum or fluorescence spectrum the specific spectral features of the markers used for marking of the liquid, determining, based on the optical absorption spectrum or intensity of fluorescence spectrum in respective spectral range, the actual concentration of every marker in the marked liquid, whereby the method is characterized by following steps:

inserting, upon receipt, the encrypted marking code identifying the marked liquid into the decrypting module, decrypting of the encrypted marking code, and as a result obtaining data on markers originally used for marking, on markers concentrations and mutual ratios of their concentrations, checking the measured concentrations and their mutual ratios correspondence to the values obtained by decrypting of encrypted marker code, and deciding whether the liquid is original or falsified.

9. Method according claim 8, characterized in that identification of the marked liquid is carried out automatically on-site and in real time.

* * * * *